US007649135B2

(12) United States Patent
Gerrits et al.

(10) Patent No.: US 7,649,135 B2
(45) Date of Patent: Jan. 19, 2010

(54) SOUND SYNTHESIS

(75) Inventors: Andreas Johannes Gerrits, Eindhoven (NL); Arnoldus Werner Johannnes Oomen, Eindhoven (NL); Marc Klein Middelink, Eindhoven (NL); Marek Szczerba, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 90 days.

(21) Appl. No.: 11/908,379

(22) PCT Filed: Feb. 1, 2006

(86) PCT No.: PCT/IB2006/050337

§ 371 (c)(1),
(2), (4) Date: Sep. 11, 2007

(87) PCT Pub. No.: WO2006/085243

PCT Pub. Date: Aug. 17, 2006

(65) Prior Publication Data

US 2008/0250913 A1 Oct. 16, 2008

(30) Foreign Application Priority Data

Feb. 10, 2005 (EP) ..... 05100945
Feb. 1, 2006 (EP) ..... 06710800

(51) Int. Cl.
*G10H 1/00* (2006.01)

(52) U.S. Cl. ..... 84/600; 700/94; 704/258

(58) Field of Classification Search ..... 84/600–602; 700/94; 704/266–268, 258
See application file for complete search history.

(56) References Cited

U.S. PATENT DOCUMENTS 5,029,509 A * 7/1991 Serra et al. ..... 84/625
5,220,629 A * 6/1993 Kosaka et al. ..... 704/260
5,248,845 A * 9/1993 Massie et al. ..... 84/622
5,686,683 A * 11/1997 Freed ..... 84/625
5,689,080 A 11/1997 Gulick
5,698,807 A * 12/1997 Massie et al. ..... 84/661
5,763,800 A * 6/1998 Rossum et al. ..... 84/603
5,812,674 A * 9/1998 Jot et al. ..... 381/17

(Continued)

FOREIGN PATENT DOCUMENTS

WO WO2004021331 A1 3/2004

(Continued)

OTHER PUBLICATIONS

Guillermo Garcia et al. "Data Compression of Sinusoidal Modeling Parameters Based on Psychoacoustic Masking"; Proceedings of the 1999 International Computer Music Conference, Center for Computer Research in Music and Acoustics, Stanford University, Oct. 22-27, 1999, pp. 40-43.

(Continued)

*Primary Examiner*—David S. Warren

(57) ABSTRACT

A device for synthesizing sound having sinusoidal components includes a selector for selecting a limited number of the sinusoidal components from each of a number of frequency bands using a perceptual relevance value. The device further includes a synthesizer for synthesizing the selected sinusoidal components only. The frequency bands may be ERB based. The perceptual relevance value may involve the amplitude of the respective sinusoidal component, and/or the envelope of the respective channel.

22 Claims, 3 Drawing Sheets

U.S. PATENT DOCUMENTS

Figure 1:
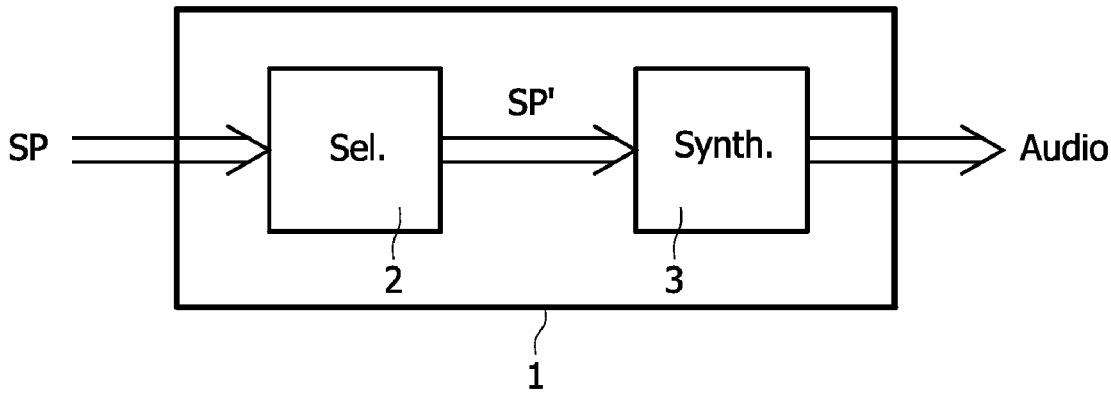

| | | | | |
|---|---|---|---|---|
| 5,880,392 | A * | 3/1999 | Wessel et al. | 84/659 |
| 5,900,568 | A * | 5/1999 | Abrams | 84/622 |
| 5,920,843 | A * | 7/1999 | Fay | 704/503 |
| 6,298,322 | B1 | 10/2001 | Lindemann | |
| 6,919,502 | B1 * | 7/2005 | Yamamoto | 84/622 |
| 7,136,418 | B2 * | 11/2006 | Atlas et al. | 375/242 |
| 7,259,315 | B2 * | 8/2007 | Tamura et al. | 84/627 |
| 7,548,852 | B2 * | 6/2009 | Den Brinker et al. | 704/219 |
| 2002/0053274 | A1 * | 5/2002 | Yahata | 84/634 |
| 2002/0176353 | A1 * | 11/2002 | Atlas et al. | 370/203 |
| 2005/0021328 | A1 * | 1/2005 | Van De Kerkhof et al. | 704/216 |
| 2005/0080616 | A1 * | 4/2005 | Leung et al. | 704/200.1 |
| 2006/0149532 | A1 * | 7/2006 | Boillot et al. | 704/203 |
| 2006/0241940 | A1 * | 10/2006 | Ramprashad | 704/229 |
| 2007/0124136 | A1 * | 5/2007 | Den Brinker et al. | 704/205 |
| 2008/0052783 | A1 * | 2/2008 | Levy | 726/26 |
| 2008/0071539 | A1 * | 3/2008 | Allen et al. | 704/251 |
| 2008/0184871 | A1 * | 8/2008 | Szczerba et al. | 84/623 |
| 2009/0055194 | A1 * | 2/2009 | Hotho et al. | 704/500 |
| 2009/0083040 | A1 * | 3/2009 | Myburg et al. | 704/500 |

FOREIGN PATENT DOCUMENTS

WO WO2006085243 A2 8/2006

OTHER PUBLICATIONS

Ted Painter et al. "Perceptual Segmentation and Component Selection in Compact Sinusoidal Representations of Audio" Proceeding. IEEE ICASSP, vol. 5, May 2001 pp. 3289-3292.

Mathieu Lagrange et al. "Real-Time Additive Synthesis of Sound by Taking Advantage of Psychoacoustics" Proceedings of the Cost G-6 Conference on Digital Audio Effects, Dec. 8, 2001, Limerick Ireland p. 1-5.

G. Marentakis et al. "Sinusoidal Synthesis Optimzation." Proceeding of the International Computer Music conference, 2002, Gfteborg, Sweden. pp. 4.

Purnhagen et al. "Sinusoidal Coding Using Loudness-Based Component Selectoin" 2002 IEEE International Conference on Acoustics, Speech, and Signal Processing Proceedings. Orlando Fl, May 13-17, 2002 pp. 4.

* cited by examiner

SOUND SYNTHESIS

The present invention relates to the synthesis of sound. More in particular, the present invention relates to a device and a method for synthesizing sound represented by sets of parameters, each set comprising sinusoidal parameters representing sinusoidal components of the sound and other parameters representing other components.

It is well known to represent sound by sets of parameters. So-called parametric coding techniques are used to efficiently encode sound, representing the sound by a series of parameters. A suitable decoder is capable of substantially reconstructing the original sound using the series of parameters. The series of parameters may be divided into sets, each set corresponding with an individual sound source (sound channel) such as a (human) speaker or a musical instrument.

The popular MIDI (Musical Instrument Digital Interface) protocol allows music to be represented by sets of instructions for musical instruments. Each instruction is assigned to a specific instrument. Each instrument can use one or more sound channels (called "voices" in MIDI). The number of sound channels that may be used simultaneously is called the polyphony level or the polyphony. The MIDI instructions can be efficiently transmitted and/or stored.

Synthesizers typically use pre-defined sound definition data, for example a sound bank or patch data. In a sound bank samples of the sound of instruments are stored as sound data, while patch data define control parameters for sound generators.

MIDI instructions cause the synthesizer to retrieve sound data from the sound bank and synthesize the sounds represented by the data. These sound data may be actual sound samples, that is digitized sounds (waveforms), as in the case of conventional wave-table synthesis. However, sound samples typically require large amounts of memory, which is not feasible in relatively small devices, in particular hand-held consumer devices such as mobile (cellular) telephones.

Alternatively, the sound samples may be represented by parameters, which may include amplitude, frequency, phase, and/or envelope shape parameters and which allow the sound samples to be reconstructed. Storing the parameters of sound samples typically requires far less memory than storing the actual sound samples. However, the synthesis of the sound may be computationally burdensome. This is particularly the case when different sets of parameters, representing different sound channels ("voices" in MIDI), have to be synthesized simultaneously (polyphony). The computational burden typically increases linearly with the number of channels ("voices") to be synthesized. This makes it difficult to use such techniques in hand-held devices.

The paper "Parametric Audio Coding Based Wavetable Synthesis" by M. Szczerba, W. Oomen and M. Klein Middelink, Audio Engineering Society Convention Paper No. 6063, Berlin (Germany), May 2004, discloses an SSC (Sinus-Soidal Coding) wavetable synthesizer. An SSC encoder decomposes the audio input into transients, sinusoids and noise components and generates a parametric representation for each of these components. These parametric representations are stored in a sound bank. The SSC decoder (synthesizer) uses this parametric representation to reconstruct the original audio input. To reconstruct the sinusoidal components, the paper proposes to collect the energy spectrum of each sinusoid into a spectral image of the signal and then synthesize the sinusoids using a single inverse Fourier transform. The computational burden involved in this type of reconstruction is still considerable, in particular when the sinusoids of a large number of channels have to be synthesized simultaneously.

In many modern sound systems, 64 sound channels can be used and larger numbers of sound channels are envisaged. This makes the known arrangement unsuitable for use in relatively small devices having limited computing power.

On the other hand there is an increasing demand for sound synthesis in hand-held consumer devices, such as mobile telephones. Consumers nowadays expect their hand-held devices to produce a wide range of sounds, such as different ring tones.

It is therefore an object of the present invention to overcome these and other problems of the Prior Art and to provide a device and a method for synthesizing the sinusoidal components of sound, which device and method are more efficient and reduce the computational load.

Accordingly, the present invention provides a device for synthesizing sound comprising sinusoidal components, the device comprising:

selection means for selecting a limited number of sinusoidal components from each of a number of frequency bands using a perceptual relevance value, and synthesizing means for synthesizing the selected sinusoidal components only.

By only synthesizing the selected sinusoidal components, a significant reduction in the computing load may be achieved while substantially maintaining the quality of the synthesized sound. The limited number of sinusoidal components that is selected and synthesized is preferably significantly less than the number available, for example 110 out of 1600, but the actual number selected will typically depend on the computational capacity of the device, the desired sound quality, and/or the number of available sinusoidal components in the band concerned.

The number of frequency bands to which the selection is applied may also vary. Preferably, the selection process is carried out in all available frequency bands, thus achieving the greatest possible reduction. However, it is also possible to select a limited number of sinusoidal components in one or only a few frequency bands. The width of the frequency bands may also vary from a few hertz to several thousands of hertz.

The perceptual relevance value preferably involves the amplitude and/or energy of the respective sinusoidal component. Any perceptual relevance values may be based upon a psycho-acoustical model which takes into account the perceived relevance of parameters (such as amplitude, energy and/or phase) to the human ear. Such a psycho-acoustical model may be known per se.

The perceptual relevance value may also involve the position of the respective sinusoidal component. Position information representing the position of a sound source in a plane (two-dimensional) or space (three-dimensional) may be associated with some or all sinusoidal components, and may be included in the selection decision. Position information may be gathered using well-known techniques and may include a set of coordinates (X, Y) or (A, L), where A is an angle and L a distance. Three-dimensional position information may of course include a set of coordinates (X, Y, Z) or (A1, A2, L).

The frequency bands are preferably based on a perceptual relevance scale, for example an ERB scale, although other scales are also possible, such as linear scales or Bark scales.

In the device of the present invention the sinusoidal components are preferably represented by parameters. These parameters may include amplitude, frequency and/or phase information. In some embodiments other components, such as transients and noise, are also represented by parameters.

The parameters may comprise amplitude parameters and/or frequency parameters and may be based upon quantized values. That is, quantized amplitude and/or frequency values may be used as parameters, or may be used to derive parameters from. This eliminates the need to de-quantize any quantized values.

It is further preferred that the parameters of all active voices are taken together. All sinusoids for all active voices are taken into account by the selection process. Instead of selecting voices (as is done in conventional synthesizers), the selection is performed on sinusoidal components. The advantage is that no voices have to be dropped and higher polyphony is obtained without increasing the computational burden.

The device may comprise a selection section for selecting parameter sets on the basis of perceptual relevance values contained in the sets of parameters. This is particularly useful if the relevance parameters are predetermined, that is, determined at an encoder. In such embodiments, the encoder may generate a bit stream into which the perceptual relevance values are inserted. Preferably, the perceptual relevance values are contained in their respective parameter sets, which in turn may be transmitted as a bit stream.

Alternatively, or additionally, the device may comprise a selection section for selecting parameter sets on the basis of perceptual relevance values generated by a decision section of the device, the decision section producing said perceptual relevance values on the basis of parameters contained in the sets.

The present invention also provides a consumer apparatus comprising a synthesizing device as defined above. The consumer apparatus of the present invention is preferably but not necessarily portable, still more preferably hand-held, and may be constituted by a mobile (cellular) telephone, a CD player, a DVD player, a solid-state player (such as an MP3 player), a PDA (Personal Digital Assistant) or any other suitable apparatus.

The present invention further provides a method of synthesizing sound comprising sinusoidal components, the method comprising the steps of:

selecting a limited number of sinusoidal components from each of a number of frequency bands using a perceptual relevance value, and synthesizing the selected sinusoidal components only.

The perceptual relevance value may involve the amplitude, phase and/or energy of the respective sinusoidal component.

The method of the present invention may further comprise the step of compensating the gains of the selected sinusoidal components for the energy loss of rejected sinusoidal components.

The present invention additionally provides a computer program product for carrying out the method defined above. A computer program product may comprise a set of computer executable instructions stored on an optical or magnetic carrier, such as a CD or DVD, or stored on and downloadable from a remote server, for example via the Internet.

The present invention will further be explained below with reference to exemplary embodiments illustrated in the accompanying drawings, in which:

FIG. 1 schematically shows a sinusoidal synthesis device according to the present invention.

Figure 2:
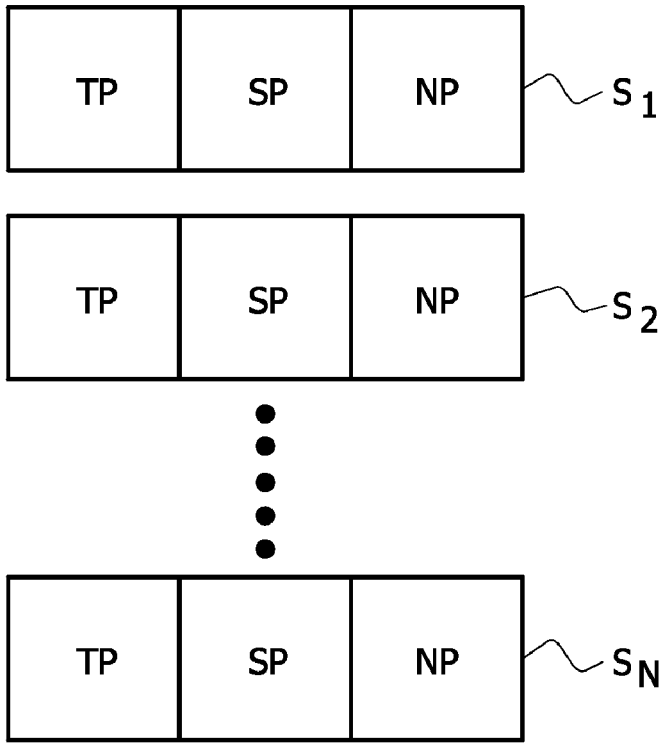

FIG. 2 schematically shows sets of parameters representing sound as used in the present invention.

Figure 3:
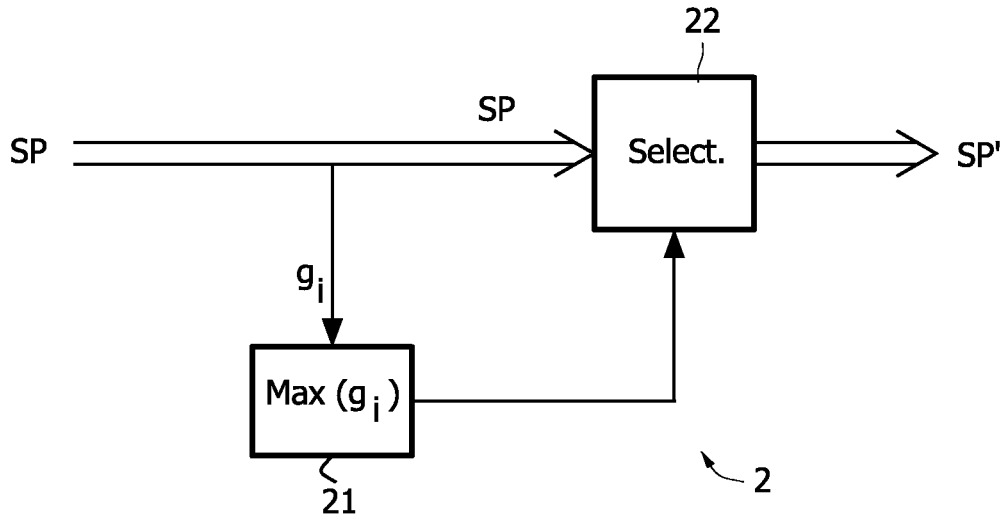

FIG. 3 schematically shows the selection part of the device of FIG. 1 in more detail.

Figure 4:
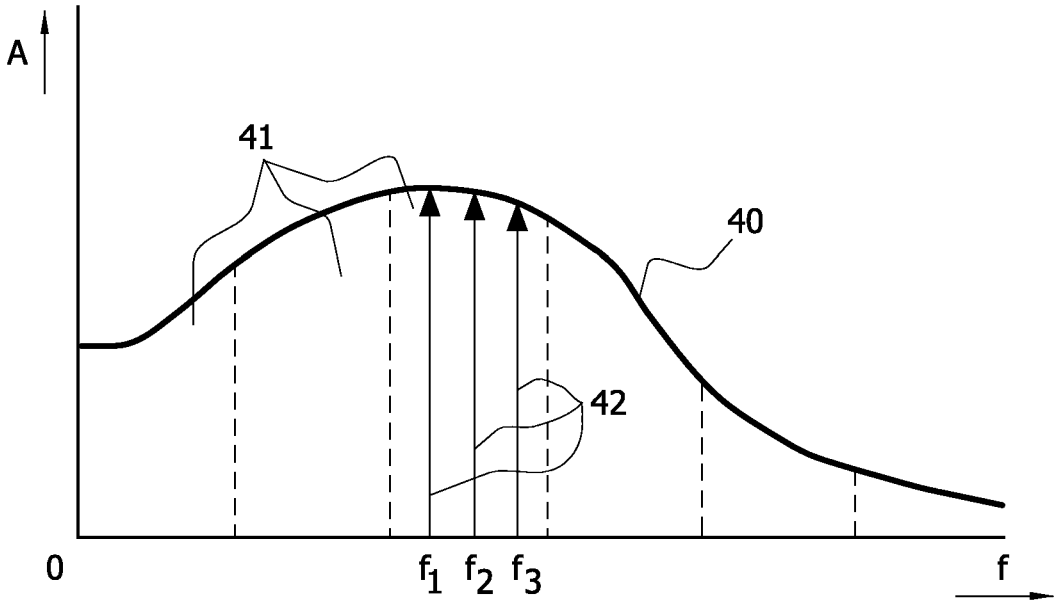

FIG. 4 schematically shows the selection of sinusoidal components according to the present invention.

Figure 5:
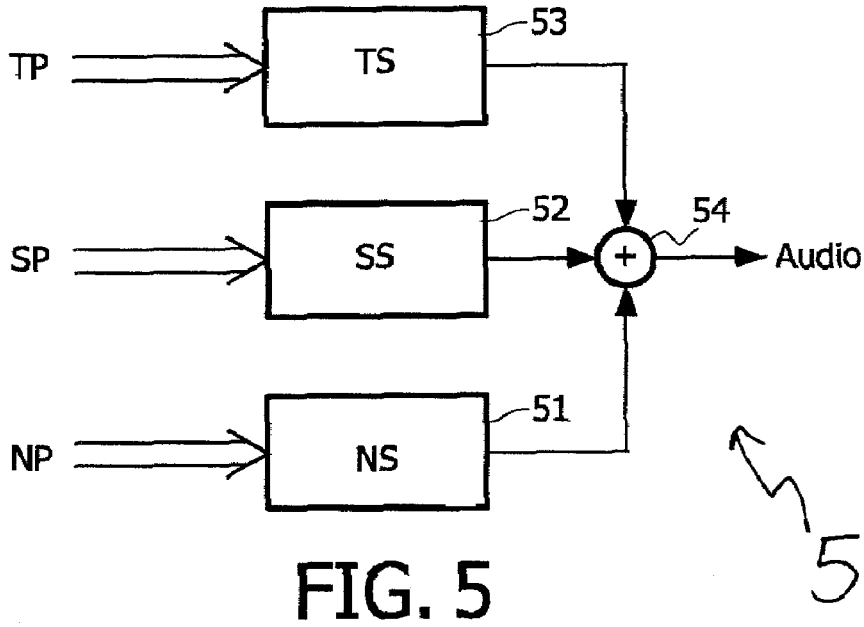

FIG. 5 schematically shows a sound synthesis device which incorporates the device of the present invention.

Figure 6:
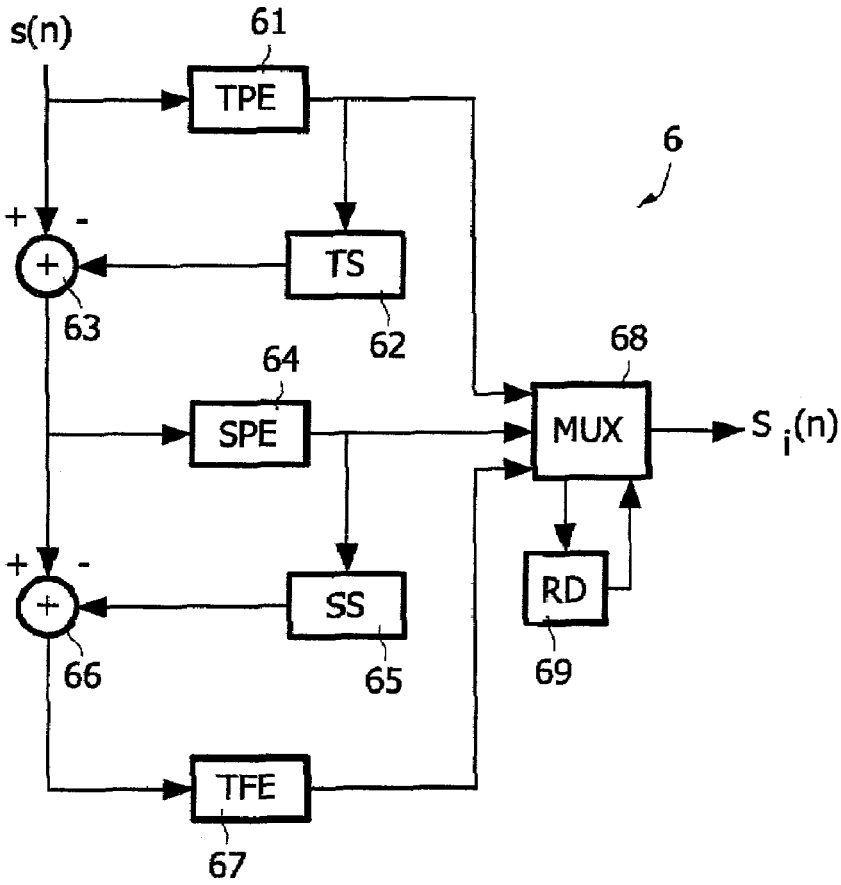

FIG. 6 schematically shows an audio encoding device.

The sinusoidal components synthesis device 1 shown merely by way of non-limiting example in FIG. 1 comprises a selection unit 2 and a synthesis unit 3. In accordance with the present invention, the selection unit 2 receives sinusoidal components parameters SP, selects a limited number of sinusoidal components parameters and passes these selected parameters SP' on to the synthesis unit 3. The synthesis unit 3 uses only the selected sinusoidal components parameters SP' to synthesize sinusoidal components in a conventional manner.

The sinusoidal components parameters SP may be part of sets $S_1, S_2, \ldots, SN$ of sound parameters, as illustrated in FIG. 2. The sets $S_i$ (i=1 . . . N) comprise, in the illustrated example, transient parameters TP representing transient sound components, sinusoidal parameters SP representing sinusoidal sound components, and noise parameters NP representing noise sound components. The sets $S_i$ may have been produced using an SSC encoder as mentioned above, or any other suitable encoder. It will be understood that some encoders may not produce transients parameters (TP) or noise parameters (NP).

Each set $S_i$ may represent a single active sound channel (or "voice" in MIDI systems).

The selection of sinusoidal components parameters is illustrated in more detail in FIG. 3, which schematically shows an embodiment of the selection unit 2 of the device 1. The exemplary selection unit 2 of FIG. 3 comprises a decision section 21 and a selection section 22. Both the decision section 21 and the selection section 22 receive the sinusoidal parameters SP. However, the decision section 21 only needs to receive suitable constituent parameters on which a selection decision is to be based.

A suitable constituent parameter is a gain $g_i$. In the preferred embodiment, $g_i$ is the gain (amplitude) of the sinusoidal components represented by the set $S_i$ (see FIG. 2). Each gain $g_i$ may be multiplied with a corresponding MIDI gain to produce a combined gain (per channel), which may be used as parameter on which a selection decision is to be based. However, instead of a gain, an energy value derived from the parameters can also be used.

The decision section 21 decides which parameters are to be used for the sinusoidal components synthesis. The decision is made using an optimization criterion, such as finding the five highest gains $g_i$, assuming that a maximum of five sinusoidals are to be selected. The actual number of sinusoidals to be selected per frequency band may be predetermined, or may be determined by other factors, based on the total band energy or the total number of sinusoids in the complete band. For example, if there are less than a predetermined number of sinusoids in one band, other bands can use more transferable components. The set numbers (for example 2, 3, 12, 23 and 41) corresponding with the selected sets are fed to the selection section 22.

The selection section 22 is arranged for selecting the sinusoidal components parameters of the sets indicated by the decision section 21. The sinusoidal components parameters of the remaining sets are disregarded. As a result, only a limited number of sinusoidal components parameters are passed on to the synthesizing unit (3 in FIG. 1) and subsequently synthesized. Accordingly, the computational load of the synthesizing unit is significantly reduced compared to synthesizing all sinusoidal components.

The inventors have gained the insight that the number of sinusoidal components parameters used for synthesis can be drastically reduced without any substantial loss of sound quality. The number of selected sets can be relatively small, for example 110 out of a total of 1600 (64 channels of 25 sinusoidals each), that is, approximately 6.9%. In general, the number of selected sets should be at least approximately 5.0% of the total number to prevent any perceptible loss of sound quality, although at least 6.0% is preferred. If the number of selected sets is further reduced, the quality of the synthesized sound gradually decreases but may, for some applications, still be acceptable.

The decision which sets to include and which not, made by the decision section 21, is made on the basis of a perceptual value, for example the amplitude (level) of the sinusoidal components. Other perceptual values, that is, values which affect the perception of the sound, may also be utilized, for example energy values and/or envelope values. Position information may also be used, allowing sinusoidal components to be selected on the basis of their (relative) positions.

Accordingly, the selection of sinusoidal components may involve (spatial) position information in addition to perceptual relevance values representing for example the amplitude, energy etc. of the respective sinusoidal components (it is noted that position information may be regarded as additional perceptual relevance values). Position information may be gathered using well-known techniques. It is possible for some but not all sinusoidal components to have associated position information, "neutral" position information could be assigned to the components having no position information.

To determine the perceptual relevance values, a quantized version of the frequency, amplitude and/or other parameters may be used, thus eliminating the need for de-quantization. This will later be explained in more detail.

It will be understood that the selection and synthesis of the sets $S_t$ (FIG. 2) and the sinusoidal components is typically carried out per time unit, for example per time frame or sub-frame. The sinusoidal components parameters, and other parameters, may therefore refer to a certain time unit only. Time units, such as time frames, may partially overlap.

The exemplary graph 40 shown in FIG. 4 schematically illustrates the frequency distribution of a sound channel (or "voice") to be synthesized. The amplitudes A of the sinusoidal components are shown as a function of the frequency f. Although only three sinusoidal components (at $f_1$, $f_2$ and $f_3$) are shown for the sake of clarity of the illustration, in practice the number of sinusoidal components may be much larger, typically 25 per channel at any given moment in time. As there may be 64 channels in some applications, this requires the synthesis of 64×25=1600 sinusoidal components which is clearly infeasible for relatively small and inexpensive devices, such as hand-held consumer devices.

In accordance with the present invention, the frequency distribution is subdivided into frequency bands 41. In the present example six frequency bands are shown, but it will be understood that both more and less frequency bands are possible, for example a single frequency band, two frequency bands, three, ten or twenty.

Each frequency band 41 originally contains a number of sinusoidal components, for example 10 or 20, although some bands 41 may contain no sinusoidal components at all, while other bands may contain 50 or more sinusoidal components. In accordance with the present invention, the number of sinusoidal components per band is reduced to a certain, limited number, for example three, four or five. The actual number selected may depend on the number of sinusoidal components originally present in the band, the width (frequency range) of the band, the total number of frequency bands, and/or the perceptual relevance values of the sinusoidal components in the band or bands.

In the example of FIG. 4, it is assumed that originally more than three sinusoidal components were present in each band, and that the three most relevant (that is, having the highest perceptual relevance values) are to be selected. In one exemplary frequency band in FIG. 4, selected sinusoidal components 42 are shown at frequencies $f_1$, $f_2$ and $f_3$. In accordance with the present invention, only these three sinusoidal components are selected and used to synthesize sound. Any remaining sinusoidal components in the frequency band concerned are not used for the synthesis and may be discarded.

However, the rejected sinusoidal components may be used for gain compensation. That is, the energy loss due to discarding sinusoidal components may be calculated and used to increase the energy of the selected sinusoidal components. As a result of this energy compensation, the overall energy of the sound is substantially unaffected by the selection process.

The energy compensation may be carried out as follows. First the energy of all (selected and rejected) sinusoidal components in a frequency band 41 is calculated. After selecting the sinusoidal components to be synthesized (the sinusoidal components at frequencies $f_1$, $f_2$ and $f_3$ in the example of FIG. 4), the energy ratio of rejected sinusoidal components and the selected sinusoidal components is calculated. This energy ratio is then used to proportionally increase the energy of the selected sinusoidal components. As a result, the total energy of the frequency band is not affected by the selection.

Accordingly, the gain compensation means, which may be incorporated in the selection section 22 of FIG. 3, may for example comprise a first and a second adding unit for adding the energy values of the rejected and selected sinusoidal components respectively, a ratio unit for determining the energy ratio of the rejected and selected sinusoidal components, and scaling units for scaling the energy or amplitude values of the selected sinusoidal components.

As mentioned above, the number of frequency bands 41 may vary. In a preferred embodiment, the frequency bands are based on a ERB (Equivalent Regular Bandwidth) scale. It is noted that ERB scales are well known in the art. Instead of an ERB scale, a Bark scale or similar scale may be used. This means that per ERB band a limited number of sinusoids is selected.

As mentioned above, a quantization of the frequencies and amplitudes may be carried out in an encoder which decomposes sound into sinusoidal components, which may in turn be represented by parameters. For example, frequencies which are available as floating point values may be converted to ERB (Equivalent Rectangular Bandwidth) values using the formula:

$$f_{rl}[sf][ch][n] = \left\lfloor 91.2 \cdot erb\left(\frac{2\pi f}{f_s}\right) + 0.5 \right\rfloor \tag{1}$$

where f is the frequency (in radians) of the $n^{th}$ sinusoid in sub-frame sf of channel ch, and $f_{rl}$[sf][ch] [n] is the (integer) representation level (rl) in the ERB scale with 91.2 representation levels per ERB (it is noted that the brackets ⌊ ⌋ indicate a rounding down operation), and where:

$$erb(f) = 21.4 \cdot \log_{10}(1 + 0.00437 \cdot f) \tag{2}$$

If the value sa holds the amplitude of the $n^{th}$ sinusoid in sub-frame sf of channel ch, then to convert to representation levels, the encoder quantizes the floating point amplitudes on a logarithmic scale with a maximum amplitude error of 0.1875 dB. The (integer) representation level $sa_{rl}$[sf] [ch] [n] is calculated by:

$$sa_{rl}[sf][ch][n] = \left\lfloor \frac{\log(sa)}{2 \cdot \log(sa_b)} + 0.5 \right\rfloor \tag{3}$$

with $sa_b$=1.0218. It is noted that this value, as well as the value 91.2 used above, and other values are determined experimentally, and that the invention is not limited to these specific values but that other values may be used instead.

The quantized values $f_{rl}$ and $a_{rl}$ are transmitted and/or stored, to be synthesized by the synthesizing device of the present invention. In accordance with the present invention, these quantized values may be used for the selection of sinusoidal components.

The de-quantization of these quantized values may be accomplished as follows. The quantized frequency may be converted into a de-quantized (absolute) frequency $f_q$ (in radians) using the formula:

$$f_q[n] = \frac{2\pi}{f_s} \cdot \frac{10^y - 1}{0.00437} \tag{4}$$

where $$y = \frac{f_{rl}[n]}{91.2 \cdot 21.4} \tag{5}$$

The decoded value is converted into a de-quantized (linear) amplitude value $sa_q$ according to:

$$sa_q[n] = sa_b^{2 \cdot sa_{rl}[n]} \tag{6}$$

where $sa_b$=1.0218 is the log quantization base corresponding to a maximum error of 0.1875 dB.

Avoiding de-quantization of all frequencies and amplitudes reduces the computational complexity of the synthesizing device considerably. Accordingly, in an advantageous embodiment of the present invention the selection means (the selection section 22 and/or the decision section 21 in FIG. 1) are arranged for selecting quantized sinusoidal components. By performing a selection on the quantized values, only the selected values need to be de-quantized and the number of de-quantization operations is considerably reduced.

A sound synthesizer in which the present invention may be utilized is schematically illustrated in FIG. 5. The synthesizer 5 comprises a noise synthesizer 51, a sinusoids synthesizer 52 and a transients synthesizer 53. The output signals (synthesized transients, sinusoids and noise) are added by an adder 54 to form the synthesized audio output signal. The sinusoids synthesizer 52 advantageously comprises a device as defined above. The synthesizer 5 is more efficient than Prior Art synthesizers as it only synthesizes a limited number of sinusoidal components without compromising the sound quality. For example, it has been found that limiting the maximum number of sinusoids from 1600 to 110 does not affect the sound quality.

The synthesizer 5 may be part of an audio (sound) decoder (not shown). The audio decoder may comprise a demultiplexer for demultiplexing an input bit stream and separating out the sets of transients parameters (TP), sinusoidal parameters (SP), and noise parameters (NP).

The audio encoding device 6 shown merely by way of non-limiting example in FIG. 6 encodes an audio signal s(n) in three stages.

In the first stage, any transient signal components in the audio signal s(n) are encoded using the transients parameter extraction (TPE) unit 61. The parameters are supplied to both a multiplexing (MUX) unit 68 and a transients synthesis (TS) unit 62. While the multiplexing unit 68 suitably combines and multiplexes the parameters for transmission to a decoder, such as the device 5 of FIG. 5, the transients synthesis unit 62 reconstructs the encoded transients. These reconstructed transients are subtracted from the original audio signal s(n) at the first combination unit 63 to form an intermediate signal from which the transients are substantially removed.

In the second stage, any sinusoidal signal components (that is, sines and cosines) in the intermediate signal are encoded by the sinusoids parameter extraction (SPE) unit 64. The resulting parameters are fed to the multiplexing unit 68 and to a sinusoids synthesis (SS) unit 65. The sinusoids reconstructed by the sinusoids synthesis unit 65 are subtracted from the intermediate signal at the second combination unit 66 to yield a residual signal.

In the third stage, the residual signal is encoded using a time/frequency envelope data extraction (TFE) unit 67. It is noted that the residual signal is assumed to be a noise signal, as transients and sinusoids are removed in the first and second stage. Accordingly, the time/frequency envelope data extraction (TFE) unit 67 represents the residual noise by suitable noise parameters.

An overview of noise modeling and encoding techniques according to the Prior Art is presented in Chapter 5 of the dissertation "Audio Representations for Data Compression and Compressed Domain Processing", by S. N. Levine, Stanford University, USA, 1999, the entire contents of which are herewith incorporated in this document.

The parameters resulting from all three stages are suitably combined and multiplexed by the multiplexing (MUX) unit 68, which may also carry out additional coding of the parameters, for example Huffman coding or time-differential coding, to reduce the bandwidth required for transmission.

It is noted that the parameter extraction (that is, encoding) units 61, 64 and 67 may carry out a quantization of the extracted parameters. Alternatively or additionally, a quantization may be carried out in the multiplexing (MUX) unit 68. It is further noted that s(n) is a digital signal, n representing the sample number, and that the sets $S_i(n)$ are transmitted as digital signals. However, the same concept may also be applied to analog signals.

After having been combined and multiplexed (and optionally encoded and/or quantized) in the MUX unit 68, the parameters are transmitted via a transmission medium, such as a satellite link, a glass fiber cable, a copper cable, and/or any other suitable medium.

The audio encoding device 6 further comprises a relevance detector (RD) 69. The relevance detector 69 receives predetermined parameters, such as sinusoidal gains $g_i$ (as illustrated in FIG. 3), and determines their acoustic (perceptual) relevance. The resulting relevance values are fed back to the multiplexer 68 where they are inserted into the sets $S_i(n)$ forming the output bit stream. The relevance values contained in the sets may then be used by the decoder to select appropriate sinusoidal parameters without having to determine their perceptual relevance. As a result, the decoder can be simpler and faster.

Although the relevance detector (RD) 69 is shown in FIG. 6 to be connected to the multiplexer 68, the relevance detector 69 may instead be directly connected to the sinusoids parameter extraction (SPE) unit 64. The operation of the relevance detector 69 may be similar to the operation of the decision section 21 illustrated in FIG. 3.

The audio encoding device 6 of FIG. 6 is shown to have three stages. However, the audio encoding device 6 may also consist of less than three stages, for example two stages producing sinusoidal and noise parameters only, or more are than three stages, producing additional parameters. Embodiments can therefore be envisaged in which the units 61, 62 and 63 are not present. The audio encoding device 6 of FIG. 6 may advantageously be arranged for producing audio parameters that can be decoded (synthesized) by a synthesizing device as shown in FIG. 1.

The synthesizing device of the present invention may be utilized in portable devices, in particular hand-held consumer devices such as cellular telephones, PDAs (Personal Digital Assistants), watches, gaming devices, solid-state audio players, electronic musical instruments, digital telephone answering machines, portable CD and/or DVD players, etc.

The present invention is based upon the insight that the number of sinusoidal components to be synthesized can be drastically reduced without compromising the sound quality. The present invention benefits from the further insight that the most effective selection of sinusoidal components is obtained when a perceptual relevance value is used as selection criterion.

It is noted that any terms used in this document should not be construed so as to limit the scope of the present invention. In particular, the words "comprise(s)" and "comprising" are not meant to exclude any elements not specifically stated. Single (circuit) elements may be substituted with multiple (circuit) elements or with their equivalents.

It will be understood by those skilled in the art that the present invention is not limited to the embodiments illustrated above and that many modifications and additions may be made without departing from the scope of the invention as defined in the appending claims.

The invention claimed is:

1. A device for synthesizing sound comprising sinusoidal components, the device comprising:

a selector for outputting selected sinusoidal parameters by selecting a limited number of sinusoidal components from each of a number of frequency bands using a perceptual relevance value, and a synthesizer connected to the selector for synthesizing selected sinusoidal components using only the selected sinusoidal parameters; and a gain compensator configured to compensate gains of the selected sinusoidal components for energy loss of rejected sinusoidal components not selected by the selector.

2. The device according to claim 1, wherein the perceptual relevance value involves at least one of the amplitude, energy and position of the respective sinusoidal component.

3. The device according to claim 1, wherein the sinusoidal components are each associated with one of a plurality of sound channels, and wherein the perceptual relevance value involves the envelope of the respective channel.

4. The device according to claim 1, wherein the sinusoidal components are represented by parameters.

5. The device according claim 4, wherein the parameters comprise at least one of amplitude parameters and frequency parameters, which parameters are based upon quantized values.

6. The device according to claim 1, wherein the frequency bands are based on a perceptual relevance scale.

7. The device according to claim 1, comprising a selection section for selecting parameter sets on the basis of perceptual relevance values contained in the sets of parameters.

8. The device of claim 1, wherein the gain compensator configured to compensate a gain in a frequency band by calculating an energy ratio of the rejected sinusoidal components and the selected sinusoidal components in the frequency band, and using the energy ratio to proportionally increase energy of the selected sinusoidal components so that a total energy of the frequency band is not affected by the selecting.

9. The device of claim 1, wherein the selector is configured to select a predetermined number of the sinusoidal components.

10. The device of claim 9 wherein, if a first band of the frequency bands includes less than the predetermined number of the sinusoidal components, then more than the predetermined number of the sinusoidal components is selected from a second band of the frequency bands.

11. The device of claim 1, wherein the limited number of sinusoidal components for the each of a number of frequency bands is determined based on a total band energy of a band of the frequency bands, or a total number of sinusoids in the band.

12. A consumer device, such as a mobile telephone, a gaming device, an audio player or a telephone answering machine, comprising a synthesizing device according to claim 1.

13. A method of synthesizing sound comprising sinusoidal components, the method comprising the acts of:

selecting by a selector a limited number of sinusoidal components from each of a number of frequency bands using a perceptual relevance value, synthesizing by a synthesizer the selected sinusoidal components only, and compensating gains of the selected sinusoidal components for energy loss of rejected sinusoidal components.

14. The method according to claim 13, wherein the perceptual relevance value involves at least one of the amplitude, energy and position of the respective sinusoidal component.

15. The method according to claim 13, wherein the sinusoidal components are each associated with one of a plurality of sound channels, and wherein the perceptual relevance value involves the envelope of the respective channel.

16. The method according to claim 13, wherein the sinusoidal components are represented by parameters.

17. The method according to claim 16, wherein each set of parameters contains perceptual relevance values.

18. The method of claim 13, wherein the compensating act includes the acts of:

calculating an energy ratio of the rejected sinusoidal components and the selected sinusoidal components in a frequency band; and using the energy ratio to proportionally increase energy of the selected sinusoidal components so that a total energy of the frequency band is not affected by the selecting act.

19. The method of claim 13, wherein the selecting act selects a predetermined number of the sinusoidal components.

20. The method of claim 19 wherein, if a first band of the frequency bands includes less than the predetermined number of the sinusoidal components, then more than the predetermined number of the sinusoidal components is selected from a second band of the frequency bands.

21. The method of claim 13, further comprising the act of determining the limited number of sinusoidal components for the each of a number of frequency bands based on a total band energy of a band of the frequency bands, or a total number of sinusoids in the band.

22. A computer program product stored on a computer readable storage medium comprising computer executable instructions for causing a computer to perform the acts of the method according to claim 13.

* * * * *